US009233268B2

(12) United States Patent
Chen

(10) Patent No.: US 9,233,268 B2
(45) Date of Patent: Jan. 12, 2016

(54) METAL SPORT AND ENTERTAINMENT FRAMEWORK WITH MULTIPLE CONFIGURATIONS

(71) Applicant: Ya-Chi Chen, New Taipei (TW)

(72) Inventor: Ya-Chi Chen, New Taipei (TW)

( * ) Notice: Subject to any disclaimer, the term of this patent is extended or adjusted under 35 U.S.C. 154(b) by 0 days.

(21) Appl. No.: 14/283,786

(22) Filed: May 21, 2014

(65) Prior Publication Data

US 2015/0335932 A1 Nov. 26, 2015

(51) Int. Cl.

| | |
|---|---|
| ***A63B 21/00*** | (2006.01) |
| ***A63B 9/00*** | (2006.01) |
| ***A63B 69/00*** | (2006.01) |

(52) U.S. Cl.

CPC ..... *A63B 9/00* (2013.01); *A63B 69/0048* (2013.01); *A63B 2009/006* (2013.01)

(58) Field of Classification Search

USPC ..... 482/27, 28

See application file for complete search history.

(56) References Cited

U.S. PATENT DOCUMENTS

| | | | | |
|---|---|---|---|---|
| 6,071,213 | A * | 6/2000 | Raasch et al. | 482/29 |
| 2002/0098948 | A1 * | 7/2002 | Yoon | 482/27 |
| 2014/0336005 | A1 * | 11/2014 | Miller | 482/27 |

* cited by examiner

*Primary Examiner* — Jerome W Donnelly

(74) *Attorney, Agent, or Firm* — Egbert Law Offices, PLLC

(57) ABSTRACT

A metal sport and entertainment framework includes a plurality of vertical metal supporting tubes, straight type horizontal metal side tubes, oblique horizontal metal side tubes, straight type horizontal metal branch tubes and oblique horizontal metal branch tubes. The vertical metal supporting tube is made of hollow metal tubes, and side tube combination hole units are arranged at interval on each vertical metal supporting tube. Straight type horizontal metal side tubes are laterally set between two vertical metal supporting tubes to form a vertical combined positioning state. An oblique combined positioning state is formed between oblique horizontal metal branch tubes and oblique horizontal metal side tubes. Thus, the framework can provide multiple configurations to meet various applications, and the detachable framework of multiple tubes combination enables more convenient transportation and individual component replacement to reduce operating cost and facilitate framework color matching for better practicability and industrial benefit.

4 Claims, 8 Drawing Sheets

METAL SPORT AND ENTERTAINMENT FRAMEWORK WITH MULTIPLE CONFIGURATIONS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a metal sport and entertainment framework, and more particularly to an innovative one which has multiple configurations.

2. Description of Related Art Including Information Disclosed Under 37 CFR 1.97 and 37 CFR 1.98

Some large frameworks are now broadly used in sports and recreation sites such as schools, parks, plazas and walkways, and various types of frameworks have different functions, such as climbing and hanging, so they are very popular among children.

Said framework is structurally made of pure metal bars or a combination of metal bars and plastic molding modules. As for the conventional structure design, most of transverse and vertical metal bar frames are usually fixed by welding, and then painted or coated on the surface of the metal bar frames. However, the following shortcomings are observed during actual applications.

First, as most transverse and vertical metal bar frames are usually welded into a combined framework, the conventional frames have shortcomings such as huge volume, inconvenience in transportation and field operation, higher operating cost and lack of efficiency.

Second, due to the combined framework formed by transverse and vertical metal bar frames in the conventional structure, separate replacement is obviously impossible in the case of deformation or damage of individual metal bar frames, and the repair has to be finished through complex cutting, welding, grinding, lacquering, which requires a lot of time and operation cost. Otherwise, the whole framework will be scrapped and replaced, thus resulting in waste of resources and higher replacement cost.

Third, as most transverse and vertical metal bar frames are usually welded into a combined framework, aesthetic design for color separation painting of various metal bars may require time-consuming tape pasting and covering works due to neat and straight bonding lines between transverse and vertical metal bar frames (note: usually staggered connection of circular tube end faces and side walls).

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the unique innovative design of the present invention wherein "a metal sport and entertainment framework with multiple configurations" comprises: said vertical metal supporting tube, straight type horizontal metal side tube, oblique horizontal metal side tube, and straight type horizontal metal branch tube, the present invention can provide multiple patterns including multi-frame shape, S-shape, L-shape, and multi-cross shape, so as to meet various applications such as climbing, hanging, swinging, and pulling-up. With such detachable framework of multiple tubes, various tubes can be disassembled into unit components of minimum volume, thus saving space and reducing cost in warehousing and transportation. In addition, each tube can be processed or painted in different colors with aesthetically-pleasing color separation effect. Therefore, the present invention enables more convenient transportation, individual component replacement to reduce our operating cost and facilitate framework color matching for better practicability and industrial benefit.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
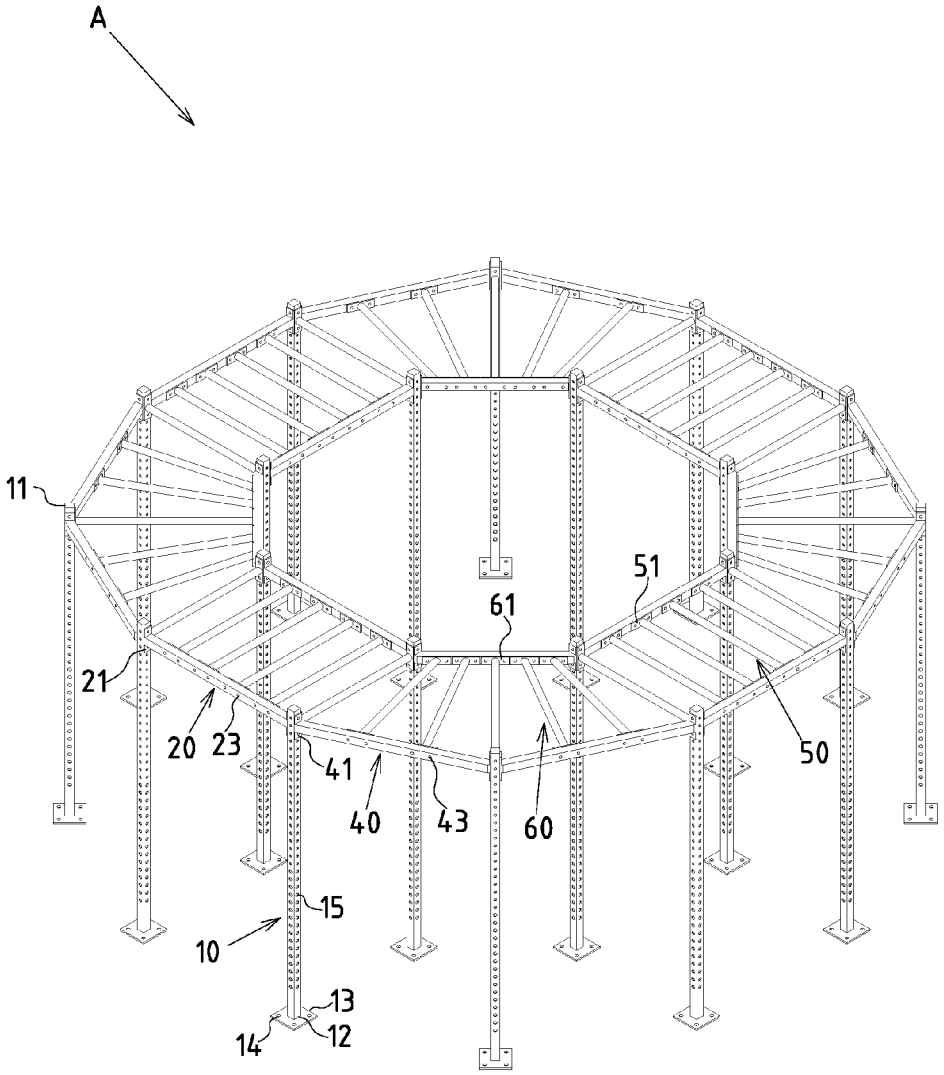
FIG. 1 is an assembled perspective view of the preferred embodiment of the present invention.
Figure 2:
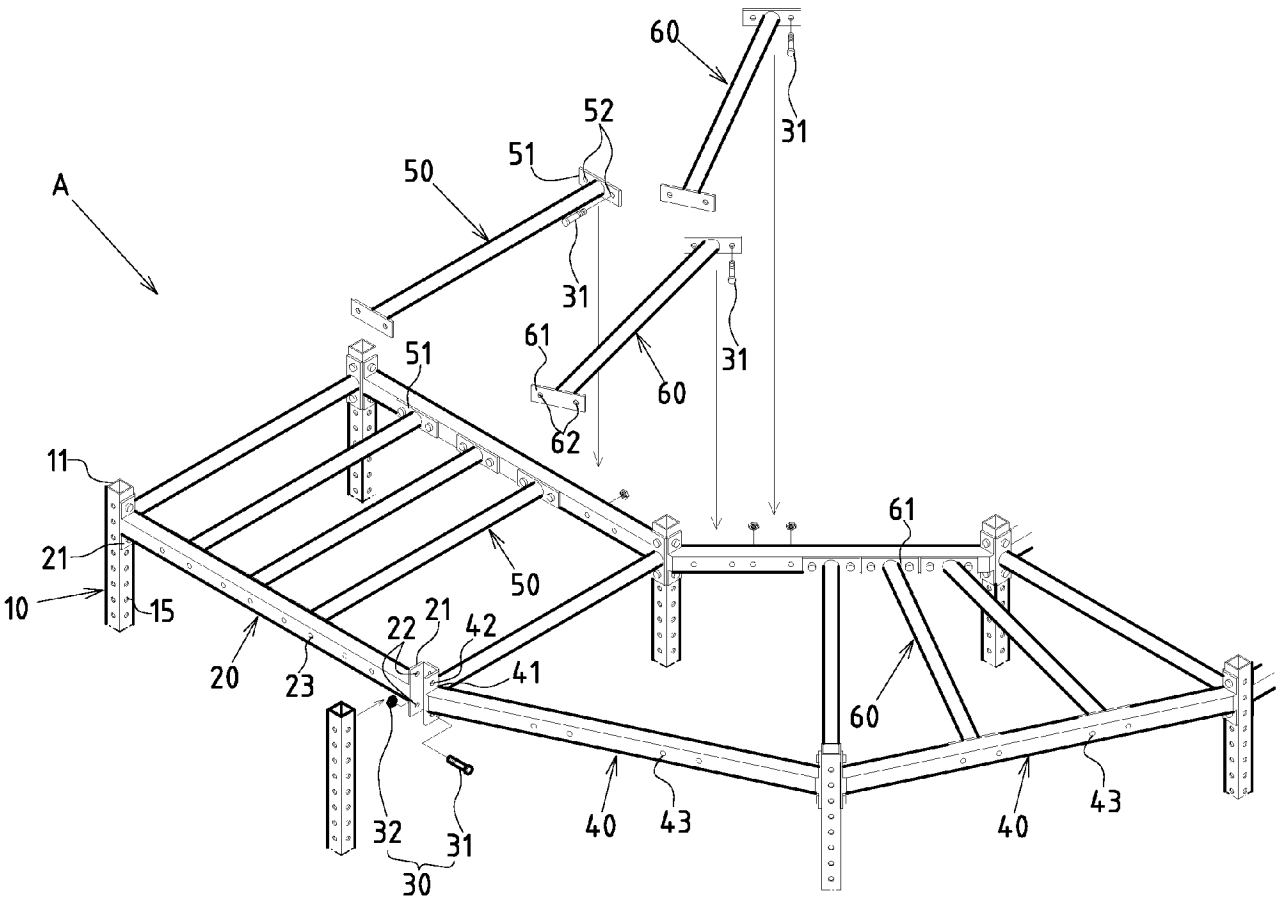
FIG. 2 is partially exploded perspective view of the preferred embodiment of the present invention.
Figure 3:
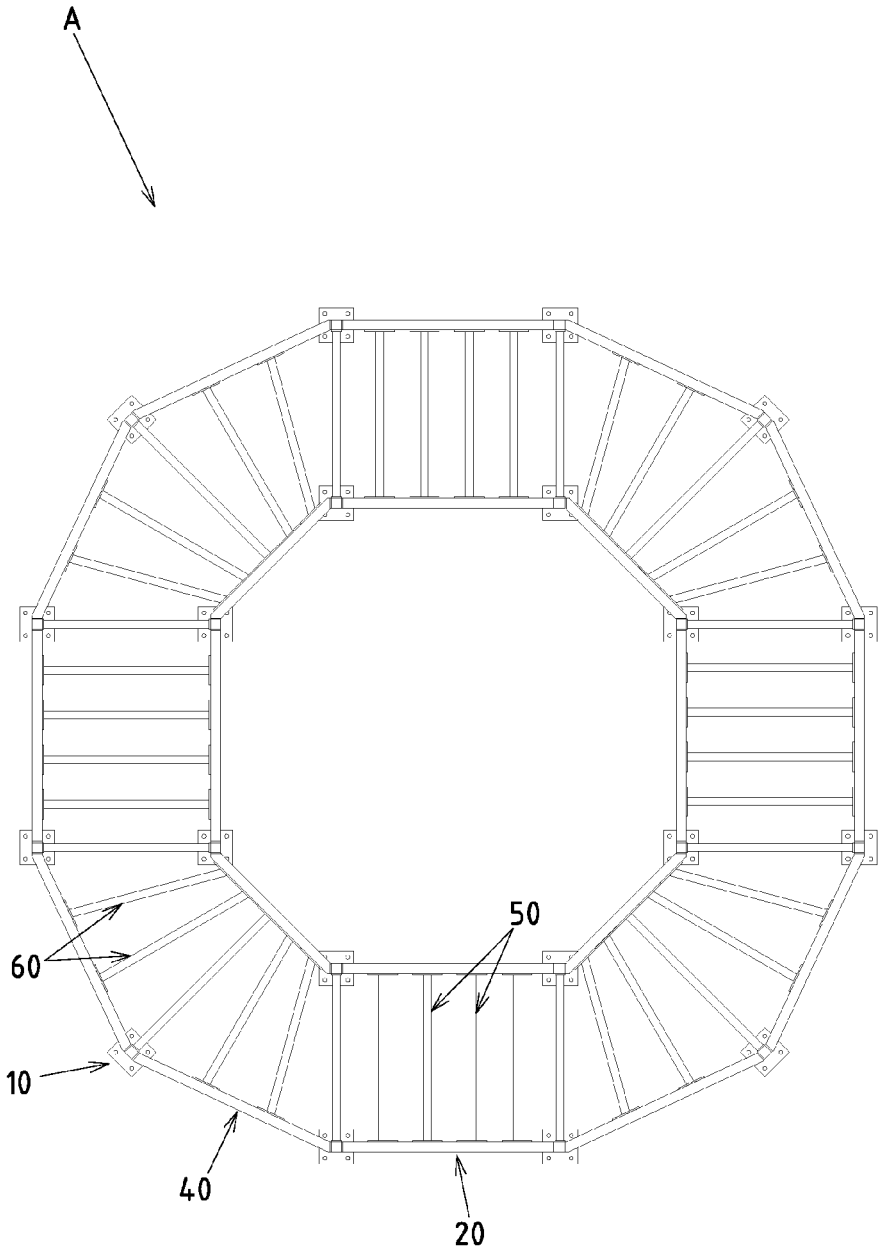
FIG. 3 is plane top view of the assembly state of the preferred embodiment of the present invention.

FIGS. 1-3 depict preferred embodiments of a metal sport and entertainment framework with multiple configurations, which, however, are provided for only explanatory purpose for patent claims. Said metal sport and entertainment framework A comprises a plurality of vertical metal supporting tubes 10, which are made of hollow metal tubes that are vertically extended with rectangular or quadrate cross sections. Each vertical metal supporting tube 10 includes a top 11 and a bottom 12 provided with an area-expanded positioning plate 13 with a plurality of mounting holes 14. Side tube combination hole units 15 are arranged laterally at interval between the top 11 and bottom 12 of each vertical metal supporting tube 10. A plurality of straight type horizontal metal side tubes 20 are transversely set between two vertical metal supporting tubes 10. Each straight type horizontal metal side tube 20 is made of hollow metal tubes that are transversely extended with rectangular or quadrate cross sections. Vertically area-expanded first composition boards 21 are separately set on two opposite ends of said straight type horizontal metal side tube 20. Said first composition board 21 is provided with the first positioning hole unit 22 that can be aligned with any side tube combination hole unit 15 set for vertical metal supporting tubes 10, and then fixed by said combined positioning member 30 to form vertical combined positioning state between straight type horizontal metal side tube 20 and vertical metal supporting tube 10. Moreover, the first branch tube combination hole units 23 are transversely set at interval on each straight type horizontal metal side tube 20. A plurality of oblique horizontal metal side tubes 40 are transversely set between two vertical metal supporting tubes 10, and each oblique horizontal metal side tube 40 is made of hollow metal tubes that are transversely extended with rectangular or quadrate cross sections. Obliquely area-expanded second composition boards 41 are separately set on two opposite ends of oblique horizontal metal side tube 40. The second composition board 41 is provided with the second positioning hole units 42 that can be aligned with any side tube combination hole unit 15 set for vertical metal supporting tubes 10, and then fixed by said combined positioning member 30 to form oblique combined positioning state between oblique horizontal metal side tube 40 and vertical metal supporting tube 10. Moreover, the second branch tube combination hole units 43 are transversely set at interval on each oblique horizontal metal side tube 40. A plurality of straight type horizontal metal side tubes 50 are laterally set between two straight type horizontal metal side tubes 20. Each straight type horizontal metal branch tube 50 is made of hollow metal tubes that are transversely extended with round cross sections. The vertically area-expanded third composition boards 51 are separately set on two opposite ends of straight type horizontal metal branch tube 50. The third composition board 51 is provided with the third positioning hole units 52 that can be aligned with any first branch tube combination hole unit 23 set for straight type horizontal metal side tube 20, and then fixed by combined positioning member 30 to form vertical combined positioning state between straight type horizontal metal branch tube 50 and straight type horizontal metal side tube 20. A plurality of oblique horizontal metal branch tubes 60 are horizontally set between two oblique horizontal metal side tubes 40, and each oblique horizontal metal branch tube 60 is made of hollow metal tubes that are transversely extended with round cross section. The obliquely area-expanded fourth composition boards 61 are separately set on two opposite ends of the oblique horizontal metal branch tube 60. The fourth composition board 61 is provided with the fourth positioning hole units 62 that can be aligned with the any second branch tube combination hole unit 43 set for oblique horizontal metal side tube 40, and then fixed by combined positioning member 30 to form oblique combined positioning state between oblique horizontal metal branch tube 60 and oblique horizontal metal side tube 40.

Figure 4:
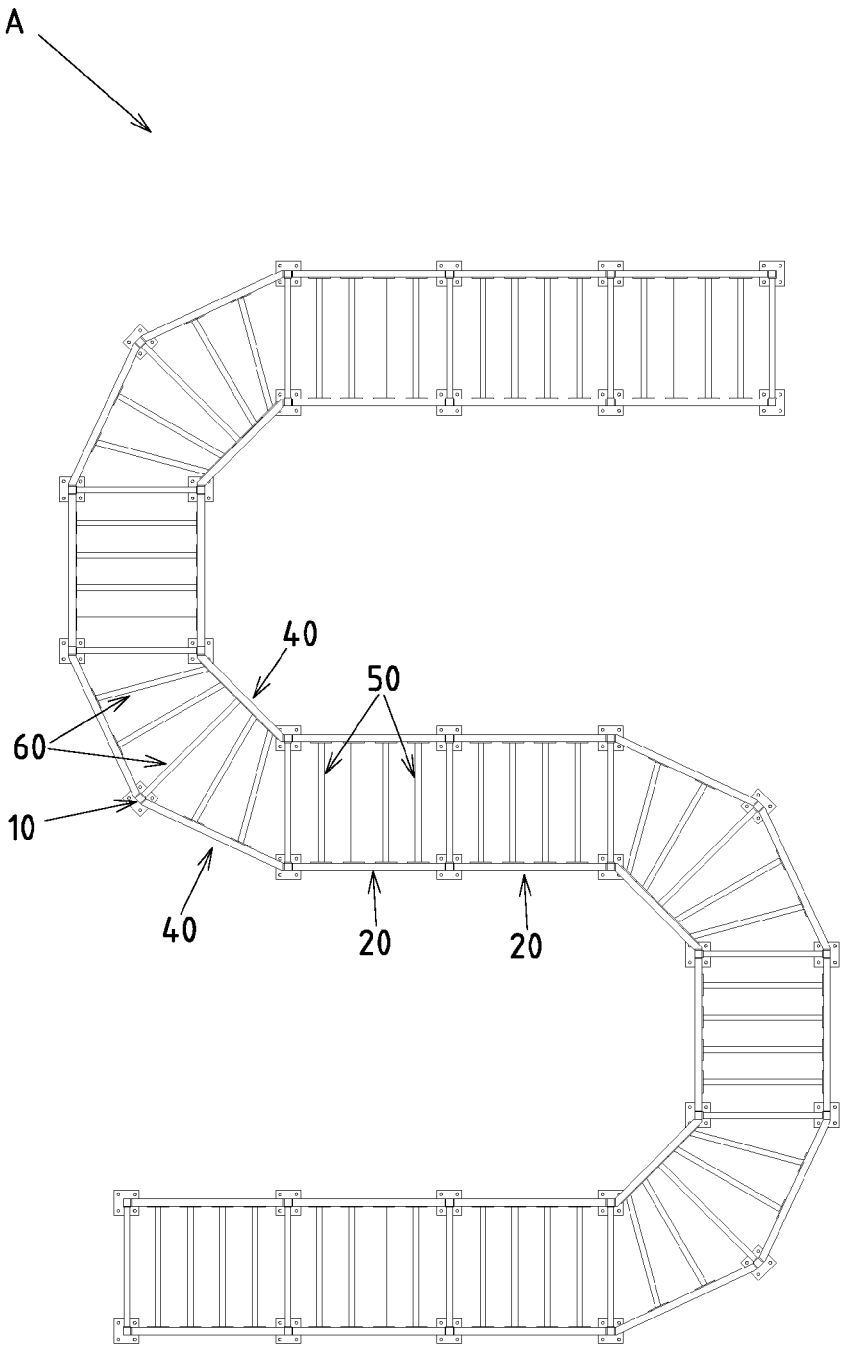
FIG. 4 is a plane top view of the assembly state of another preferred embodiment of the present invention.
Figure 5:
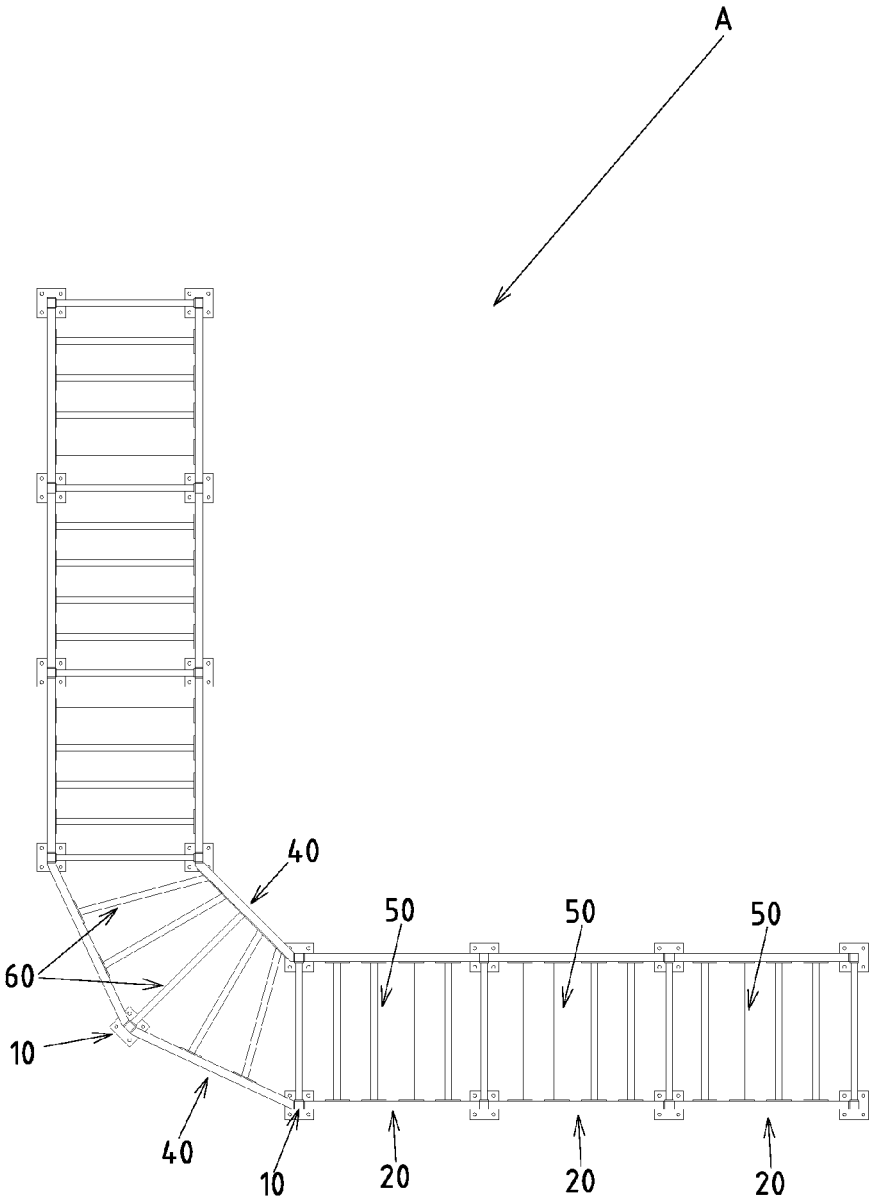
FIG. 5 is plane top view of the assembly state of another preferred embodiment of the present invention.
Figure 6:
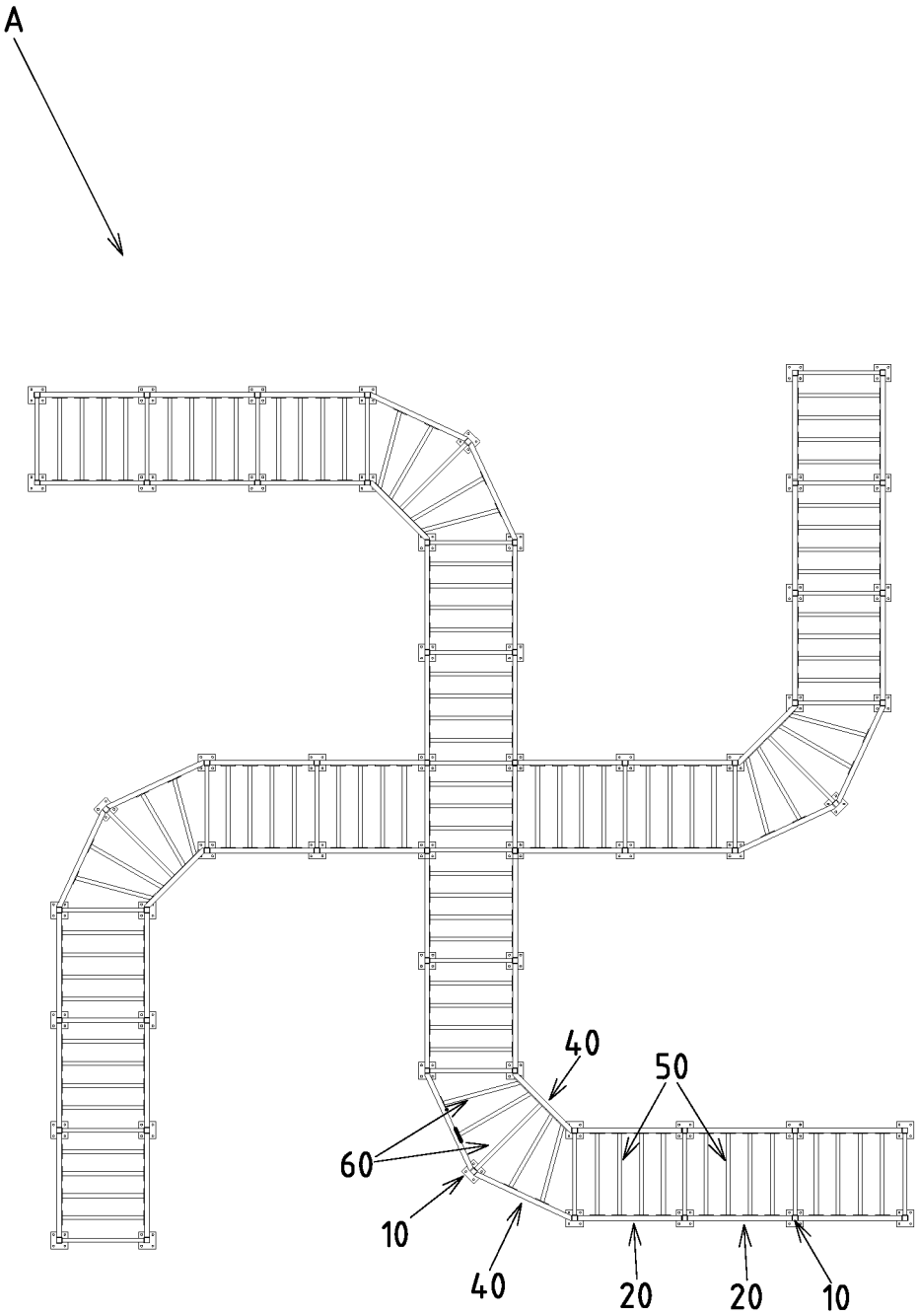
FIG. 6 is a plane top view of the assembly state of another preferred embodiment of the present invention.

With said structure, the metal sport and entertainment framework A can be assembled into multiple combination frameworks of multi-frame shape, S-shape, L-shape and multi-cross shape, based on said vertical metal supporting tube 10, straight type horizontal metal side tube 20, oblique horizontal metal side tube 40, straight type horizontal metal branch tube 50 and oblique horizontal metal branch tube 60. FIG. 3 depicts a top view of said metal sport and entertainment framework A of multi-frame shape (note: it is of octagon from inside view). FIG. 4 depicts a top view of said metal sport and entertainment framework A of S-shape. FIG. 5 depicts an L-shape, and FIG. 6 depicts a multi-cross shape. Yet, the preferred embodiments are not limited to those mentioned above, and all patterns of said vertical metal supporting tube 10, straight type horizontal metal side tube 20, oblique horizontal metal side tube 40, straight type horizontal metal branch tube 50 and oblique horizontal metal branch tube 60, shall be embraced in the present invention.

Referring to FIG. 2, said combined positioning member 30 can be locked securely by bolt 31 and nut 32. Such positioning type is a preferred embodiment, but existing quick-release combined positioning structure is also an optional embodiment, which, however, is not suitable for the operating environment with higher safety considerations.

Of which, said oblique horizontal metal branch tube 60 is of a plurality of different oblique patterns, namely, the oblique angles of the fourth composition boards 61 set on two opposite ends of oblique horizontal metal branch tube 60 are varied to suit for the changes of included angle between two oblique horizontal metal side tubes 40.

Figure 7:
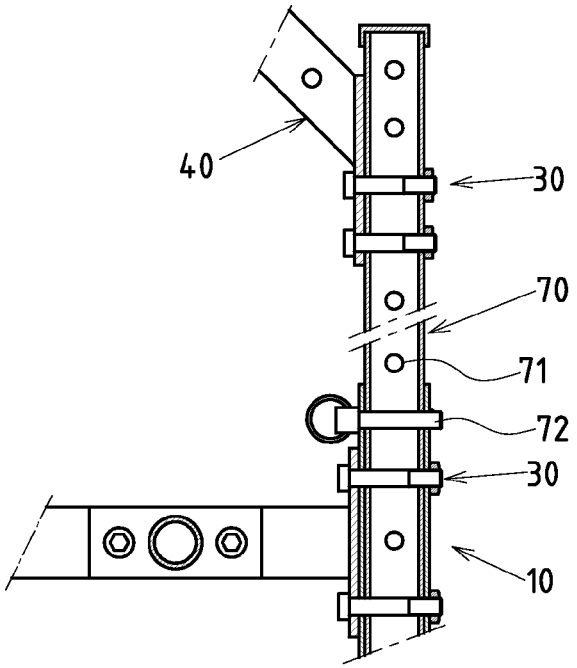
FIG. 7 is a vertical section view of the preferred embodiment of the present invention showing a vertical metal supporting tube including a scalable top tube.
Figure 8:
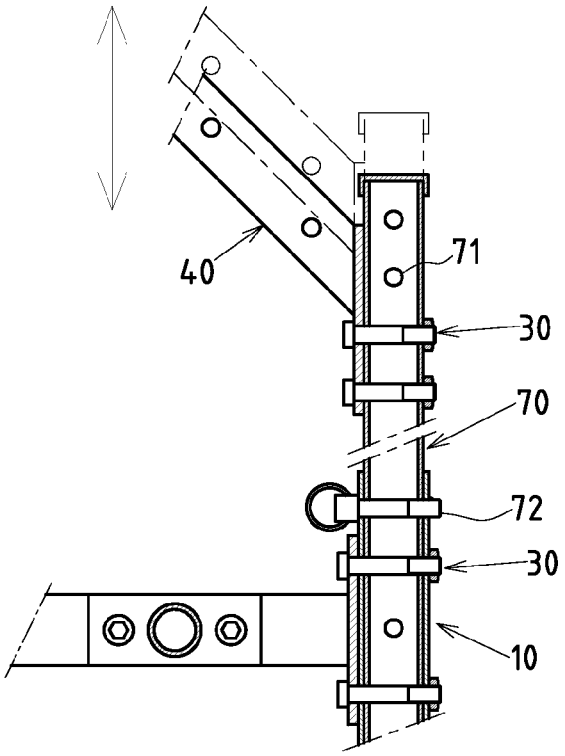
FIG. 8 is a schematic view of the adjustable state of scalable top tube of the preferred embodiment depicted in FIG. 7

Referring to FIGS. 7 and 8, said vertical metal supporting tube 10 includes a scalable top tube 70 which can be adjusted in relation to said vertical metal supporting tube 10. A plurality of adjustment holes 71 that can be aligned selectively are set between scalable top tube 70 and vertical metal supporting tube 10, allowing for positioning with the plug pin 72 by adjusting said scalable top tube 70.

Figure 9:
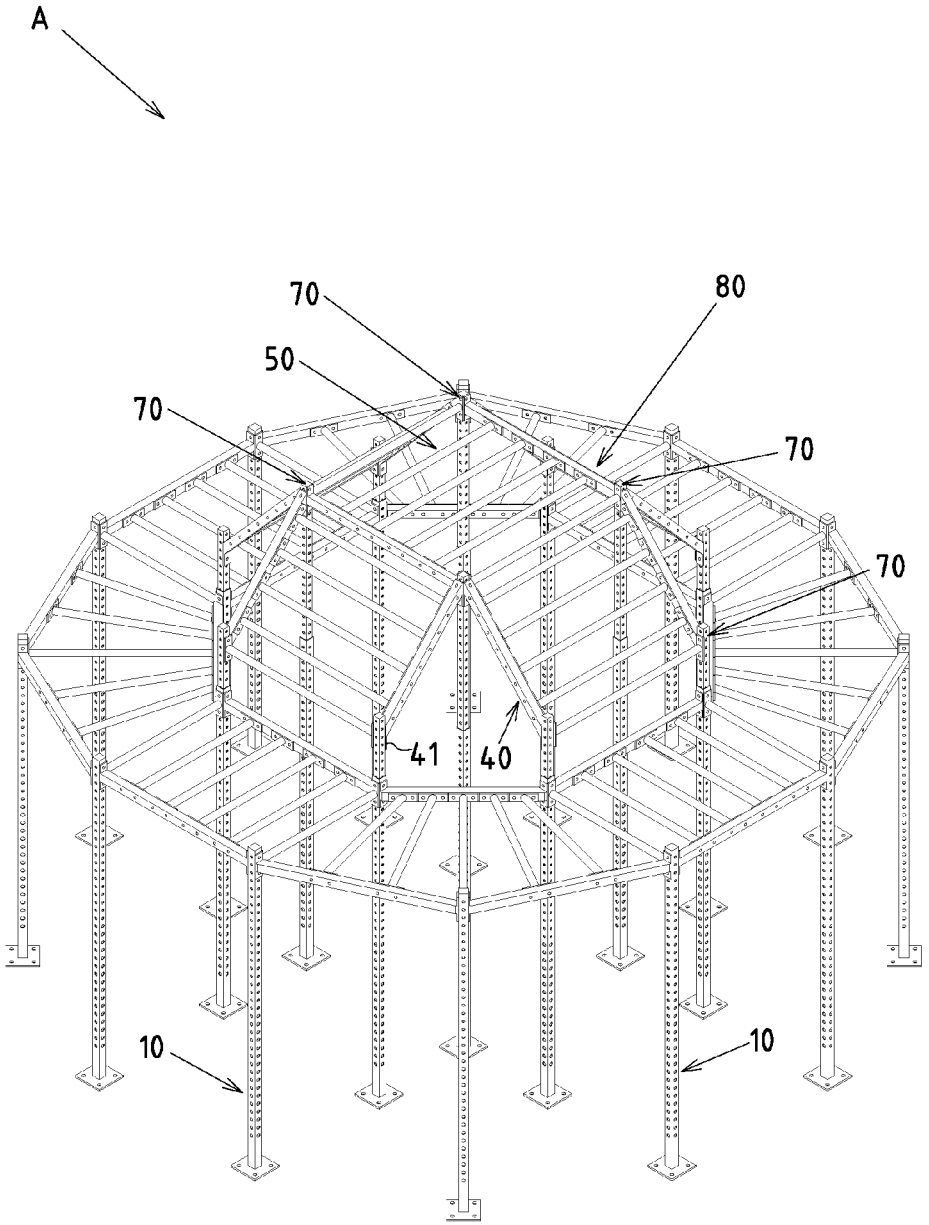
FIG. 9 is an application view of the present invention showing a structure including an arch upper-frame.

Referring to FIG. 9, said metal sport and entertainment framework A also includes an arch upper-frame 80, which, based on the oblique angle of the second composition boards 41 set at two opposite ends of said oblique horizontal metal side tube 40, is vertically and also obliquely incorporated between top sections of two vertical metal supporting tubes 10 with height difference, thus forming the oblique arched part of the arch upper-frame 80. Besides, the top sections of two higher vertical metal supporting tubes 10 are connected by straight type horizontal metal branch tube 50 to form the top section of the arch upper-frame 80. With the setting of arch upper-frame 80, the overall 3D structure of the metal sport and entertainment framework A can be further enhanced, so as to increase the difficulty and pleasure for climbing. Additionally, the inclined end of oblique horizontal metal side tube 40 shown in FIG. 9 is assembled into the top section of said scalable top tube 70, but this is not required due to said scalable top tube 70. When said scalable top tube 70 is not set, the inclined end of oblique horizontal metal side tube 40 is assembled into the top section of vertical metal supporting tube 10.

I claim:

1. A framework that can have multiple configurations, the framework comprising:

a plurality of vertical metal supporting tubes having a rectangular or quadrate cross section, each of said plurality of vertical metal supporting tubes having a top and a bottom provided with a positioning plate having a plurality of mounting holes, a plurality of side tube holes are arranged laterally in spaced relation between the top and the bottom of each of said plurality of vertical metal supporting tubes;

a plurality of straight horizontal metal side tubes transversely positioned between an adjacent pair of said plurality of vertical metal supporting tubes, each of said plurality of straight type horizontal metal side tubes having a rectangular or quadrate cross section, vertical first composition boards are separately set on opposite ends of said horizontal metal side tube, the first composition board is provided with a first positioning hole that can be aligned with one of said plurality of side tube holes and fixed by a positioning member so as to form a vertical positioning state between the straight horizontal metal side tube and the vertical metal supporting tube, first branch tube holes are transversely set in spaced relation on each of said plurality of straight horizontal metal side tubes;

a plurality of oblique horizontal metal side tubes transversely set between the adjacent pairs of vertical metal supporting tubes, each of said plurality of oblique horizontal metal side tubes having a rectangular or quadrate cross section, second composition boards are separately set on opposite ends of the oblique horizontal metal side tubes, the second composition board is provided with second positioning holes that can be aligned with one of the side tube holes and fixed by the positioning member so as to form an oblique positioning state between the oblique horizontal metal side tube and the vertical metal supporting tube, second branch tube holes are transversely formed in spaced relation on each of said plurality of oblique horizontal metal side tubes;

a plurality of straight horizontal branch tubes each having a round cross section, third composition boards are separately positioned at opposite ends of each of said plurality of straight horizontal branch tubes, the third composition board has the third positioning holes that are aligned with the first branch tube holes and fixed by the positioning member to form a vertical positioning state between the straight horizontal metal branch tube and the straight horizontal metal side tube; and a plurality of oblique horizontal metal branch tubes horizontally positioned between adjacent pairs of said plurality of oblique horizontal metal side tubes, each of said plurality of oblique horizontal metal branch tubes having a round cross section, fourth composition boards are separately set on opposite ends of the oblique horizontal metal branch tubes, the fourth composition board has fourth positioning holes aligned with the second branch tube holes and fixed by the positioning member to form an oblique positioning state between the oblique horizontal metal branch tube and the oblique horizontal metal side tube.

2. The framework of claim 1, further comprising:

a bolt and a nut cooperative with the positioning member.

3. The framework of claim 1, wherein the oblique horizontal metal branch tube has a plurality of different oblique configurations.

4. The framework of claim 1, wherein the vertical metal supporting tube includes a scalable top tube which can be adjusted in relation to the vertical metal supporting tube, a plurality of adjustment holes are aligned selectively between said scalable top tube and the vertical metal supporting tube so as to allow for positioning with a plug pin by adjusting said scalable top tube.

* * * * *